US012235014B2

(12) United States Patent
Rowland et al.

(10) Patent No.: US 12,235,014 B2
(45) Date of Patent: Feb. 25, 2025

(54) FAIRLY DISTRIBUTED PLINTH

(71) Applicant: J.F.R. Enterprises Inc., Johns Creek, GA (US)

(72) Inventors: Jay F. Rowland, Johns Creek, GA (US); Craig Harrison, Santa Rosa Beach, FL (US)

(73) Assignee: J.F.R. Enterprises Inc., Johns Creek, GA (US)

( * ) Notice: Subject to any disclaimer, the term of this patent is extended or adjusted under 35 U.S.C. 154(b) by 56 days.

(21) Appl. No.: 18/092,161

(22) Filed: Dec. 30, 2022

(65) Prior Publication Data

US 2023/0213237 A1 Jul. 6, 2023

Related U.S. Application Data

(60) Provisional application No. 63/295,720, filed on Dec. 31, 2021.

(51) Int. Cl.
*B65D 19/00* (2006.01)
*B65D 19/02* (2006.01)
(Continued)

(52) U.S. Cl.
CPC ..... *F24F 13/32* (2013.01); *F24F 13/222* (2013.01)

(58) Field of Classification Search
CPC ..... F24F 13/32; F24F 13/222; B65D 19/00; B65D 19/385; B65D 19/36; B65D 19/02;
(Continued)

(56) References Cited

U.S. PATENT DOCUMENTS 3,046,843 A * 7/1962 Rowe ..... F41A 23/54 248/346.02
3,526,195 A * 9/1970 Maryonovich ..... B65D 19/004 108/901
(Continued)

FOREIGN PATENT DOCUMENTS

AU 2006100199 A4 4/2006
WO WO-1996031341 A1 10/1996
WO WO-2007068036 A1 6/2007

OTHER PUBLICATIONS

Polyslab™ Hot Water System Support Base Range. RectorSeal a CSW Industrials Company. pp. 1-2. Downloaded on Jan. 11, 2023 from https://www.rectorseal.com.au/wp-content/uploads/2018/10/Polyslab-PizzaBaseWEB-FLY-R50278AU-0818.pdf.
(Continued)

*Primary Examiner* — Nkeisha Smith
(74) *Attorney, Agent, or Firm* — Eric W. Cernyar; Huffman Law Group, PC

(57) ABSTRACT

An equipment pad generally includes at least four risers and at least four channels. Riser tops extend outwardly and broaden from a central portion of the equipment pad and comprise an equipment support surface. Channel beds and side walls extend outwardly and may curve or bend from the central portion of the equipment pad to comprise a ground support surface. Channel openings together span from 15% to 50% of the perimeter of the equipment pad and allow drainage to exit the channels. The horizontal area of the channel beds comprises from 20% to 50% of the total combined horizontal area of the channel beds and riser tops. Typically, each channel is wider at the channel opening than at the central portion of the equipment pad. The pad's corners typically have a combined length of at least 20% of the perimeter of the equipment pad.

28 Claims, 13 Drawing Sheets

(51) Int. Cl.
*B65D 19/38* (2006.01)
*F24F 13/22* (2006.01)
*F24F 13/32* (2006.01)

(58) Field of Classification Search
CPC ..... B65D 19/04; B65D 19/18; B65D 19/40; B65D 19/0046
USPC ..... 248/678, 500, 346.01, 346.02
See application file for complete search history.

(56) References Cited

U.S. PATENT DOCUMENTS 3,788,581 A 1/1974 Rutzick
3,790,115 A * 2/1974 Fox ..... F25D 23/006 248/346.5
4,050,659 A 9/1977 McCannon et al.
4,480,748 A * 11/1984 Wind ..... B65D 71/0096 108/55.3
4,505,449 A 3/1985 Turner et al.
4,869,456 A 9/1989 Jacobs
D308,247 S 5/1990 Adam et al.
5,076,534 A 12/1991 Adam
5,224,508 A * 7/1993 Bates, Jr. ..... D06F 39/081 4/251.1
5,230,601 A * 7/1993 Apps ..... B65D 21/0212 414/788.2
5,307,931 A * 5/1994 Gillispie ..... B65D 90/24 206/386
5,664,394 A 9/1997 Sweeney
5,833,207 A 11/1998 Hagenhoff et al.
5,895,025 A 4/1999 Alesi et al.
5,961,093 A 10/1999 Jones et al.
6,050,539 A 4/2000 Millen
6,395,384 B1 5/2002 Adam
6,521,371 B1 * 2/2003 Lavanture ..... H01M 50/267 429/96
6,631,878 B1 10/2003 Adam
6,769,367 B2 * 8/2004 Schutz ..... B65D 19/004 108/51.11
6,769,538 B2 * 8/2004 Oswald ..... A47K 5/00 220/571
6,797,894 B2 * 9/2004 Montagnino ..... G01G 21/22 177/253
6,927,183 B1 8/2005 Christen
6,971,320 B1 12/2005 Maldonado-Cortes et al.
7,114,693 B1 * 10/2006 Olgado ..... H01L 21/67742 248/637
D562,963 S 2/2008 Cantolino
7,334,421 B1 2/2008 Cantolino
D590,123 S 4/2009 Hermans
D590,124 S 4/2009 Hermans
D590,572 S 4/2009 Hermans
D590,573 S 4/2009 Hermans
7,552,821 B1 * 6/2009 Demers ..... A63F 9/1044 206/499
D600,874 S 9/2009 Hermans
D600,875 S 9/2009 Hermans
7,607,699 B2 * 10/2009 Langford ..... A45C 3/02 190/110
D608,917 S 1/2010 Ward et al.
7,780,140 B1 8/2010 Ward et al.
7,891,635 B2 2/2011 Rowland
7,900,795 B1 3/2011 Cantolino
8,136,782 B2 3/2012 Rowland
8,152,129 B2 4/2012 Hermans et al.
8,640,632 B1 2/2014 Odle et al.
8,708,304 B2 * 4/2014 Dysinger ..... F24C 15/107 108/51.11
8,740,505 B1 6/2014 Rowland
9,016,653 B1 * 4/2015 Cox, Jr. ..... B65D 19/0002 52/292
9,074,812 B2 * 7/2015 Rowland ..... B65D 1/40
9,188,273 B2 * 11/2015 Merhar ..... F16M 11/00
9,395,034 B1 * 7/2016 Rowland ..... F24F 1/60
9,440,770 B2 * 9/2016 Mueller ..... B65D 19/385
9,464,452 B2 * 10/2016 Higgs ..... E04G 21/3238
9,557,094 B2 * 1/2017 Rowland ..... B65D 1/34
9,702,106 B1 7/2017 Rowland
9,841,137 B1 * 12/2017 Pierce ..... A47C 7/002
10,246,844 B2 4/2019 Rowland
10,408,493 B1 9/2019 Carpenter et al.
10,559,742 B1 2/2020 Sting et al.
10,753,641 B2 8/2020 Rowland
10,794,028 B1 10/2020 Rowland
10,962,256 B1 3/2021 Xu
11,111,054 B2 * 9/2021 Wu ..... B65D 19/38
11,365,845 B1 * 6/2022 Carpenter ..... F24F 13/32
2005/0040308 A1 * 2/2005 Sweeney ..... F24F 13/32 248/346.02
2005/0247851 A1 11/2005 Kessler et al.
2019/0128562 A1 5/2019 Xu
2021/0348801 A1 11/2021 Krause et al.

OTHER PUBLICATIONS

Goliath Furnace Riser. RectorSeal. A CSW Industrials Company. pp. 1-2. Downloaded on Jan. 11, 2023 from https://rectorseal.com/goliath-furnace-riser-group/.
Mars® Service & Installation. Mars Stackable Condenser Pads p. SI-4. pp. 1-3. Downloaded on Jan. 11, 2023 from https://www.marsdelivers.com/wps/wcm/connect/ab8b707d-8459-4c4e-9cbd-a63d4043162d/Service_Installation_f.pdf?MOD=AJPERES&CONVERT_TO=url&CACHEID=ROOTWORKSPACE-ab8b707d-8d59-4c4e-9cbd-a63d4043162d-om7zBr.
Mars® Service & Installation. Mars Heat Pump Risers p. SI-6. pp. 1-3. Downloaded on Jan. 11, 2023 from https://www.marsdelivers.com/wps/wcm/connect/ab8b707d-8d59-4c4e-9cbd-a63d4043162d/Service_Installation_f.pdf?MOD=AJPERES&CONVERT_TO=url&CACHEID=ROOTWORKSPACE-ab8b707d-8d59-4c4e-9cbd-a63d4043162d-om7zBr.
Pump-Up®—Bramec Corporation—Wholesale Distributer of Parts & Supplies. pp. 1-3. Downloaded on Jan. 11, 2023 from https://bramec.com/index.php/product/pump-up/.
Equipment Pad—Bramec Corporation—Wholesale Distributer of Parts & Supplies. pp. 1-3. Downloaded on Jan. 11, 2023 from https://bramec.com/index.php/product/equipment-pad/.
QwikPad® for Condensers and Accessories. QwikProducts® by Mainstream Engineering. pp. 1-6. Downloaded on Jan. 11, 2023 from https://www.qwik.com/product/qwikpad-for-condensers-and-accessories/.
Equipmentguard Maintenance-free Modular Equipment Base Pad. AssetGuard by Carbo Ceramics Inc. pp. 1-3. Downloaded on Jan. 11, 2023 from https://carboceramics.com/products/equipment-ground-protection/equipment-base-pads/equipmentguard-product-detail.
Superslab™ Equipment Base. Air Diffusion Agencies. pp. 1-2. Downloaded on Jan. 11, 2023 from https://www.airdiffusion.com.au/images/pdfs/brochures/ADA/Superslab_equipement_base.pdf.

* cited by examiner

FAIRLY DISTRIBUTED PLINTH

RELATED APPLICATIONS

This application claims the benefit of my U.S. provisional patent application Ser. No. 63/295,720 filed Dec. 31, 2021, entitled "Fairly Distributed Plinth," which is herein incorporated by reference and referred to herein as "the provisional application."

TECHNICAL FIELD

The present disclosure generally relates to equipment pads, and more particularly relates to an equipment pad for supporting an HVAC unit and associated methods for making such.

BACKGROUND

My existing patents and their cited prior art provide the backstory.

There remains a need in the art for an improved equipment pad that better protects homeowner investment in HVAC systems and better enables installing technicians to provide that protection.

SUMMARY

An equipment pad generally includes at least four risers and at least four channels. The at least four risers have riser tops that extend outwardly and broaden from a central portion of the equipment pad along at least portions of the at least four risers and turn to extend downwardly to form a perimeter side wall of the equipment pad, wherein the at least four risers comprise an equipment support surface. The at least four channels have channel beds and channel side walls that extend outwardly from the central portion of the equipment pad, wherein the at least four channels comprise a ground support surface. The channel side walls adjoin or merge into the perimeter side walls of the equipment pad to form channel openings that allow drainage (whether condensate or precipitation) to exit the at least four channels. The horizontal area of the channel beds comprises from about 20% to 50% of the total combined horizontal area of the channel beds and riser tops of the equipment pad. The ground support surface of the at least four channels supports the equipment pad on soil, and the equipment support surface of the at least four risers supports the equipment placed on the equipment pad.

In most embodiments, each channel is located between and shares side walls with two of the at least four risers, and each channel is wider at the channel opening than at the central portion of the equipment pad. The equipment pad may further comprise bends in the at least four risers or the at least four channels, a structural channel-spanning member, channel dam walls, a secondary riser that branches off of one of the at least four risers, or at least eight risers and at least eight channels.

In another configuration, an equipment support pad generally comprises a terrace that extends outward from a central portion of the support pad to form at least four legs that are broader at the perimeter of the pad than at the area where they extend from the central portion (the at least four legs support the equipment loaded thereon), a ground support surface that bears the equipment-loaded support pad on soil, channels disposed between the terrace and ground support surface (and comprising channel side walls, channel beds, and channel openings defined along the perimeter of the support pad), and perimeter side walls connecting the terrace and channels about the perimeter of the equipment pad and adjoining the channel openings. The channel openings together span from about 15% to 50% of the perimeter of the equipment pad.

In most embodiments, the terrace has a greater area than the area of the channel beds and the perimeter side walls extend from the channels to form corners having continuous side walls. The equipment pad may further comprise at least five to eight channels and at least five to eight legs of the terrace and have structural or other profiles on the terrace, ground support surface, channels, or perimeter side walls. A perimeter side wall on one side of the support pad may comprise two or more channel openings.

The equipment support pad may be shaped to be nestable with a similarly shaped pad, have at least one channel side wall that bends from a center portion of the equipment pad toward a perimeter side wall, or have a ground support surface comprising varying heights or curvatures along the channel beds. A geocomposite or sheet-like material may be attached to the perimeter side walls or the bottom surface of the pad. Incremental risers may be shaped for placement on the terrace or in the channels.

In another configuration, an equipment pad generally comprises a plurality of equipment-supporting plateaus extending from a central region of the equipment pad toward a perimeter of the equipment pad and flaring laterally, a plurality of channels comprising channel openings and formed by channel side walls and ground-contacting channel beds, and sidewalls comprising the channel sidewalls and perimeter sidewalls joining the plateaus and channels. The channel openings span sections of the pad where the channel sidewalls merge into the perimeter sidewalls. The equipment support pad has a polygonal shape with a plurality of corners that are defined by a corresponding one of the plateaus and that may have a combined length of at least 20% of the perimeter of the pad. The plateaus extend along a nonlinear path (which may be curved or otherwise bent) from the central region of the pad to the perimeter of the pad. The channel openings typically span from 15% to 50% of the perimeter of the pad, unless the channel side walls form a pocket between adjoining plateaus such that the channel openings span from 2% to 30% of the perimeter of the pad.

Other systems, devices, methods, features, and advantages of the disclosed product and methods for forming an equipment pad will be apparent or will become apparent to one with skill in the art upon examination of the following figures and detailed description. All such additional systems, devices, methods, features, and advantages are intended to be included within the description and to be protected by the accompanying claims.

BRIEF DESCRIPTION OF THE DRAWINGS

The present disclosure may be better understood with reference to the following figures. Corresponding reference numerals designate corresponding parts throughout the figures, and components in the figures are not necessarily to scale.

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

DETAILED DESCRIPTION

Figure 1:
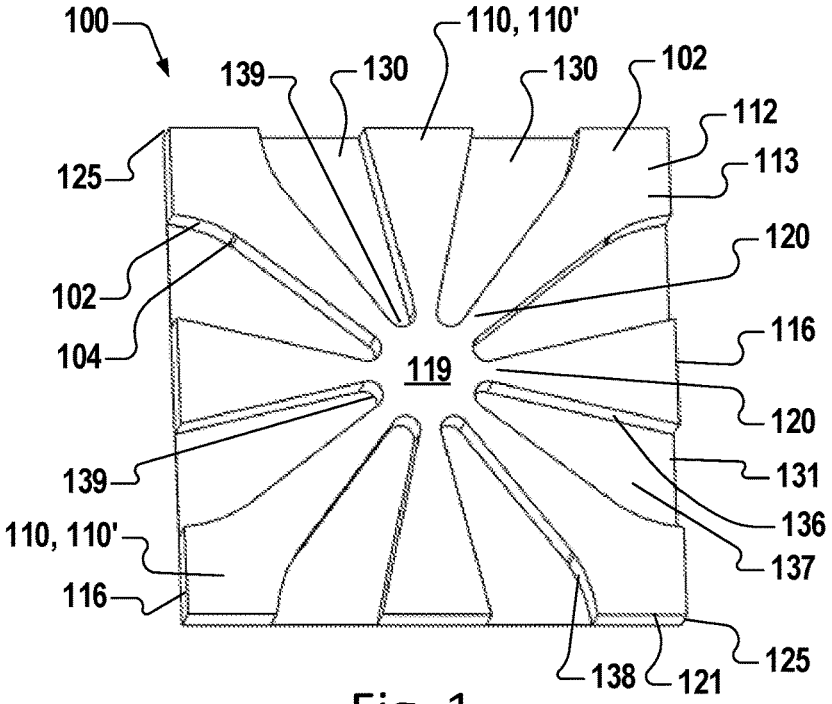
FIG. 1 is a top perspective view of an equipment pad.
Figure 2:
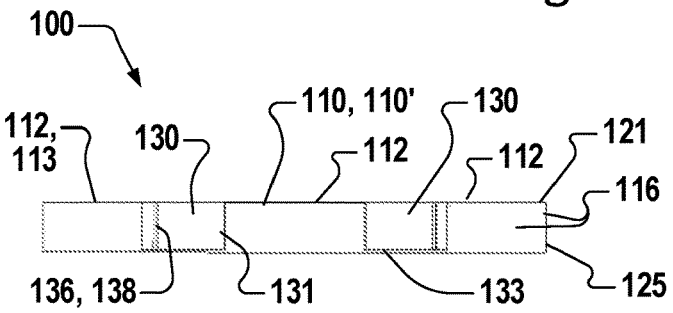
FIG. 2 is a side view of the pad of FIG. 1.

Any reference to "invention" within this document is a reference to an embodiment of a family of inventions, with no single embodiment including features that are necessarily included in all embodiments, unless otherwise stated. Furthermore, although there may be references to "advantages" provided by some embodiments, other embodiments may not include those same advantages, or may include different advantages. Any advantages described herein are not to be construed as limiting to any of the claims.

In describing preferred and alternate embodiments of the technology described herein, specific terminology is employed for the sake of clarity. Technology described herein, however, is not intended to be limited to the specific terminology so selected, and it is to be understood that each specific element includes all technical equivalents that operate in a similar manner to accomplish similar functions. Discussions pertaining to specific compositions of matter, if present, are presented as examples only and do not limit the applicability of other compositions of matter, especially other compositions of matter with similar properties, unless otherwise indicated.

FIGS. 1-44 illustrate a plinth or equipment pad 100 that is largely hollow, yet provides excellent support for both the equipment 10 installed on the pad 100 and the pad 100 resting upon the ground 3. By providing such "fairly distributed" support, the equipment pad 100 improves upon hollow prior art pads that fail to maintain the level, monolithic functionality expected by contractors and homeowners—such failures made obvious by the appearance of pads having thin structural support or sinking as the soil 3 underneath erodes over time. FIG. 9 shows the relationship of the equipment 10 (typically a condensing unit that has a pan or other base 11) positioned upon the equipment pad 100 and ground 3. The terms "ground," "soil," "on grade," and similar terms may be used interchangeably to describe the common installation of a pad outside a home or other structure.

An equipment pad 100 comprises a top surface 102 and a bottom surface 103 that generally defines the thickness of the material used to make the pad 100. As the pad 100 is usually thermoformed, injection molded, compression molded, or otherwise formed in the same vein and manufactured of plastics, carbon, fiber cement, or various composites, the material is relatively thin and the top and bottom surfaces 102, 103 are located near each other. Typically at least one profile 104 is located on the top or bottom surface 102, 103 to serve one or more functions.

In FIGS. 1-4, equipment pad 100 comprises legs or riser(s) 110 having riser portions 110'. A riser 110 comprises a riser top 112 with an equipment support surface 113, such that multiple risers 110 together form a platform, plateau, or terrace to support and level the equipment 10 on their respective equipment support surfaces 113. The riser top(s) 112 and equipment support surface(s) 113 may or may not be synonymous with each other, or with the top surface 102, depending upon the configuration. (For example, the riser top 112 and top surface 102 may dip down and back up, such that the top of the dip is not an equipment support surface 113.) The riser 110 extends outwardly from an origination area 120 proximate a central region or central portion 119 of the pad 100 and turns downwardly to form a perimeter side wall 116. The turning or termination of the riser 110 at the perimeter side wall 116 is the perimeter edge 121. One or more perimeter side walls 116 form a generally vertical side corner 125 of the pad 100, with most pads being rectangular and having four side corners 125, though the pad 100 is not limited to four square corners 125. The perimeter side wall 116 typically tapers outward as the pad 100 is molded with some draft to aid manufacturing and nestable stacking with a similarly shaped pad 100, though the draft and taper may be minimal to none. A riser 110 does not have to be of uniform height or serve as one uniform equipment support surface 113, but may vary in height along its length, unless so specified; thus, the equipment support surface 113 may comprise less area than the riser top 112.

Equipment pad 100 further comprises channels 130 having channel side wall(s) 136, channel bed 137 between channels side wall(s) 136, ground support surface 133, and a mouth, outlet, or channel opening 131 at the perimeter side wall(s) 116. Channel 130 functionality is at least threefold—to provide ground support, to allow drainage, and to provide structural strength to the entire equipment pad 100—and these functions must be balanced with competing requirements of pad design. A channel 130 originates at a channel head 139 proximate the central portion 119 of the pad 100 and extends outwardly to the channel opening 131. The riser top 112 turns downwardly to form the channel side wall(s) 136, which are equivalent to riser side walls. The channel side wall(s) 136 meet the perimeter side wall(s) 116 on or proximate the perimeter of the pad 100, whether the meeting portion of the side walls 116, 136 is clearly defined or is, for example, a curved portion or transition. (The "perimeter" of the pad 100 is the pad's 100 effective footprint, which typically is a convex polygonal boundary that most closely encloses the sides of the equipment pad 100. Thus, the perimeter of the pad 100 generally is also a convex polygonal boundary that extends tightly around the effective footprint. The perimeter of the pad 100 is not limited to a convex polygonal boundary, as the footprint may be non-convex. In practice, a common meaning would be understood by an ordinary person seeing "a pad.") Channel openings 131 span sections of the pad 100 where the channel side walls 136 merge into the perimeter side walls 116.

As the channel 130 extends outwardly, a typically non-linear ("not a straight line") turn, curve, flare, or bend 138 in the channel 130 changes the shape or direction of the channel 130 and the respective riser 110, as the channel 130 and riser 110 share channel side walls 136. With or without a bend 138, both risers 110 and channels 130 generally grow wider toward the perimeter side walls 116 than their widths where they originate from the central portion 119 of the pad 100. The risers 110 and channels 130 may then narrow at one or more points unless otherwise specified. In a preferred embodiment, channels 130 do not narrow to the point of holding debris or restricting egress of drainage, and the channels 130 are wider at the channel openings 131 than at the central portion 119 of the pad 100. Bends 138 in a riser 110 extending to a side corner 125 typically turn an adjacent channel 130 away from that side corner 125 nearest the channel opening 131. This structure increases riser 110 and perimeter side wall 116 area and also directs some drainage away from downslope side corners 125. The underside (bottom surface 103) of the channel bed 137 provides the ground support surface 133, though the entirety of the underside of the channel bed 137 is not required to contact the soil 3 to be one ground support surface 133, especially given the fact that ground contact will change over the life of the installation. Likewise, the bottom surface 103 of the pad may or may not be synonymous with the ground support surface 133.

Figure 3:
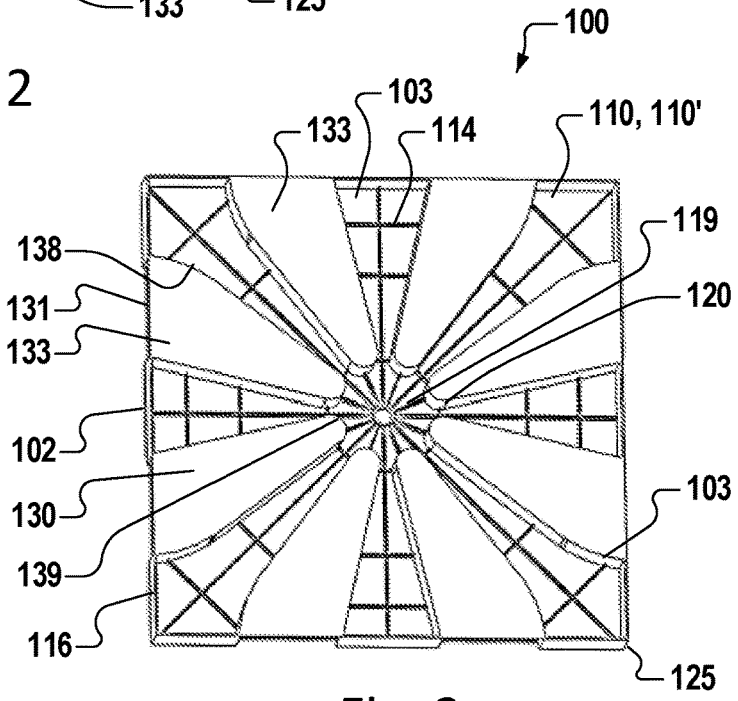
FIG. 3 is a bottom perspective view of the pad of FIG. 1.
Figure 4:
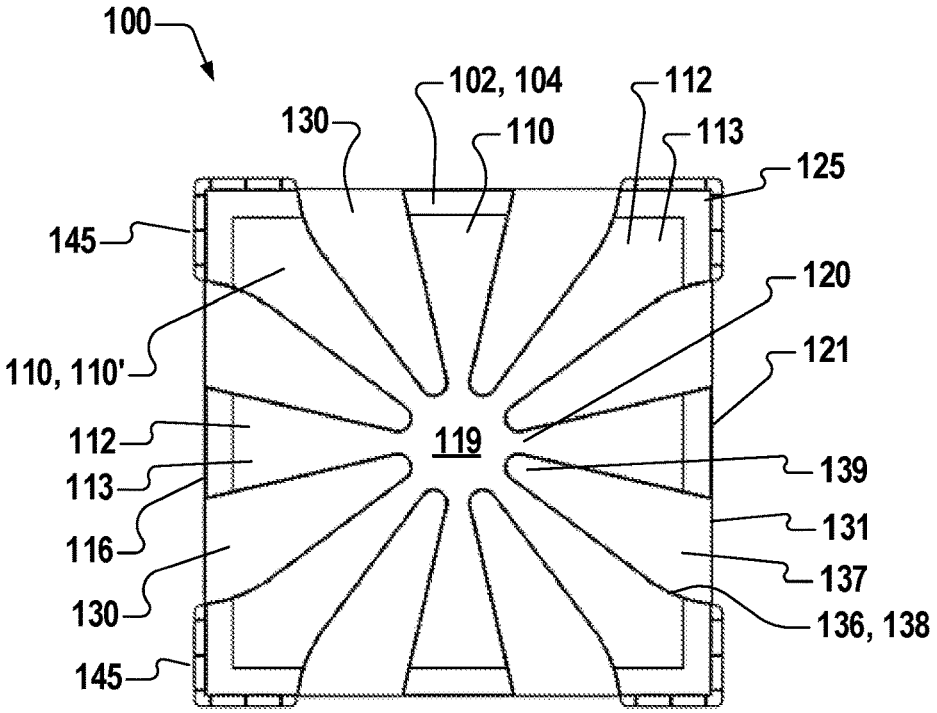
FIG. 4 is a top view of the pad of FIG. 1 with perimeter flanges.
Figure 5:
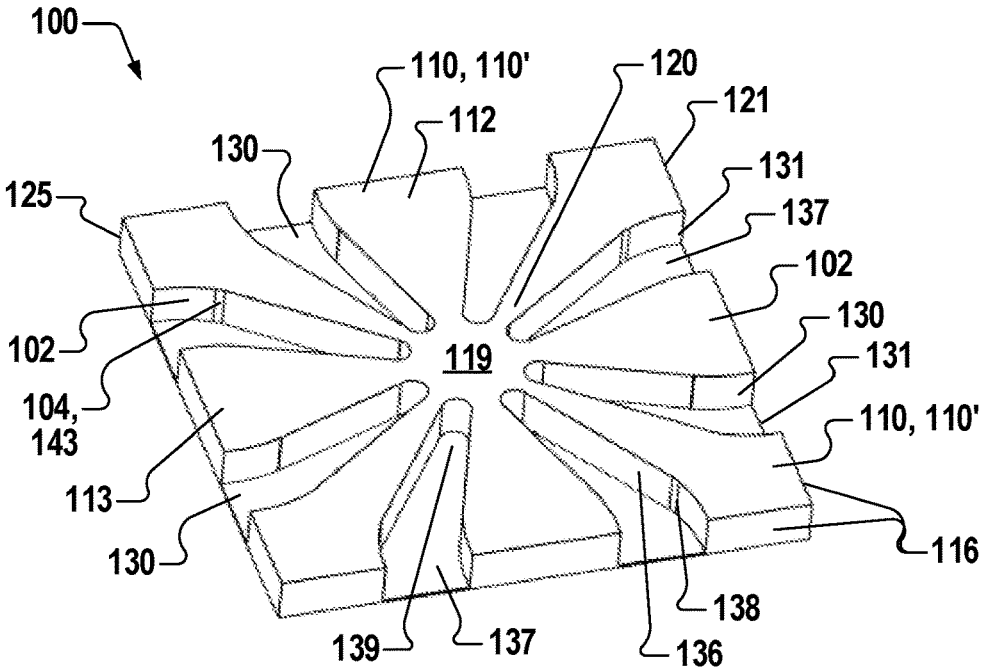
FIG. 5 is a top perspective view of an equipment pad.
Figure 6:
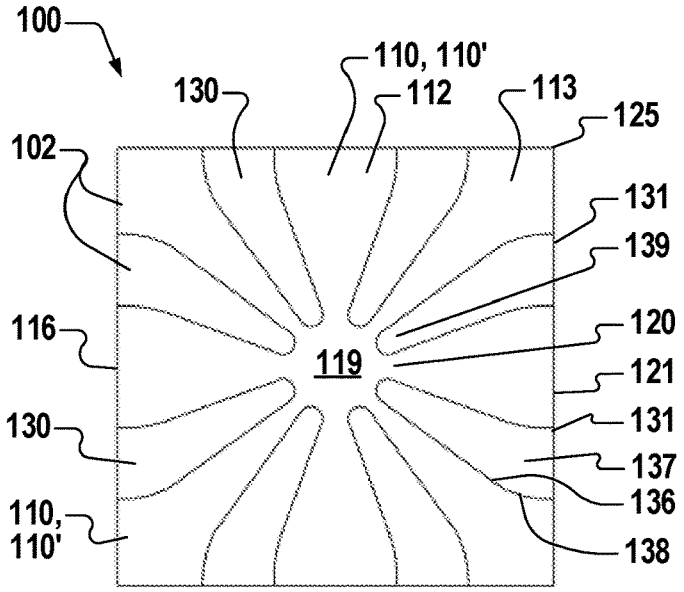
FIG. 6 is a top view of the pad of FIG. 5.

FIG. 3 illustrates ribbing 114 under the equipment support surface 113 or riser top 112. FIG. 4 illustrates a profile 104 on the top surface 102 that resembles a finished edge of poured concrete. Other profiles may direct drainage across the top surface 102. FIG. 4 also shows a lip or flange 145 around the side corners 125. FIG. 5 illustrates a surface profile 104 or structural profile 143 on the channel side wall(s) 136 that may be an inverted rib for structural strength.

One leg or riser 110 typically extends to each side corner 125, and at least one riser 110 typically extends to each side of the pad 100 between side corners 125. Risers 110 to the side corners 125 are longer than risers 110 to the sides between side corners 125. As shown in the remaining drawings, the risers 110 are envisioned to cover designs of various shapes and number. Equipment pads 100 generally have at least four risers 110, and preferably at least eight, typically with a corresponding number of channels 130. In a preferred embodiment, the side corners 125 and a majority of the perimeter side walls 116 are monolithic or have a monolithic appearance, and the perimeter side walls 116 of the plurality of side corners 125 have a combined length of at least 30% of the perimeter of the pad 100 (range 25% to 55%, and preferably 30% to 45%). Stated numerically, the channel openings 131 together span from about 15% to 50% of the pad's 100 perimeter, and preferably from about 25% to 45%. In FIGS. 1-4, the horizontal extents of the channel openings 131 span about 42% of the pad's 100 perimeter. Typically the terrace or riser top 112 has a greater area than the area of the channel beds 137. In a preferred embodiment, the area of the terrace or riser tops 112, when the pad 100 is set on soil 3 and viewed from above, comprise from about 50% to 80% (preferably 55% to 75%) of the top surface area of the equipment pad, not accounting for slightly sloped side walls 116, 136. The area of the channel beds 137 comprise the respective about 20% to 50% (preferably 25% to 45%). Stated another way, the horizontal area of the channel beds 137 typically comprises from 20% to 50% of the total combined horizontal area of the channel beds and riser tops of the equipment pad. In FIGS. 1-4, the area of the channel beds 137 comprise about 47% of the pad 100. Finally, it is worth noting that multiple risers 110 joined at a central (or other) portion 119 may be alternately and interchangeably characterized as only one riser 100 having multiple riser portions 110'. It should be understood that the choice of either of such characterizations for a competing product does not avoid or escape potential infringement of claims using the alternate description.

Figure 25:
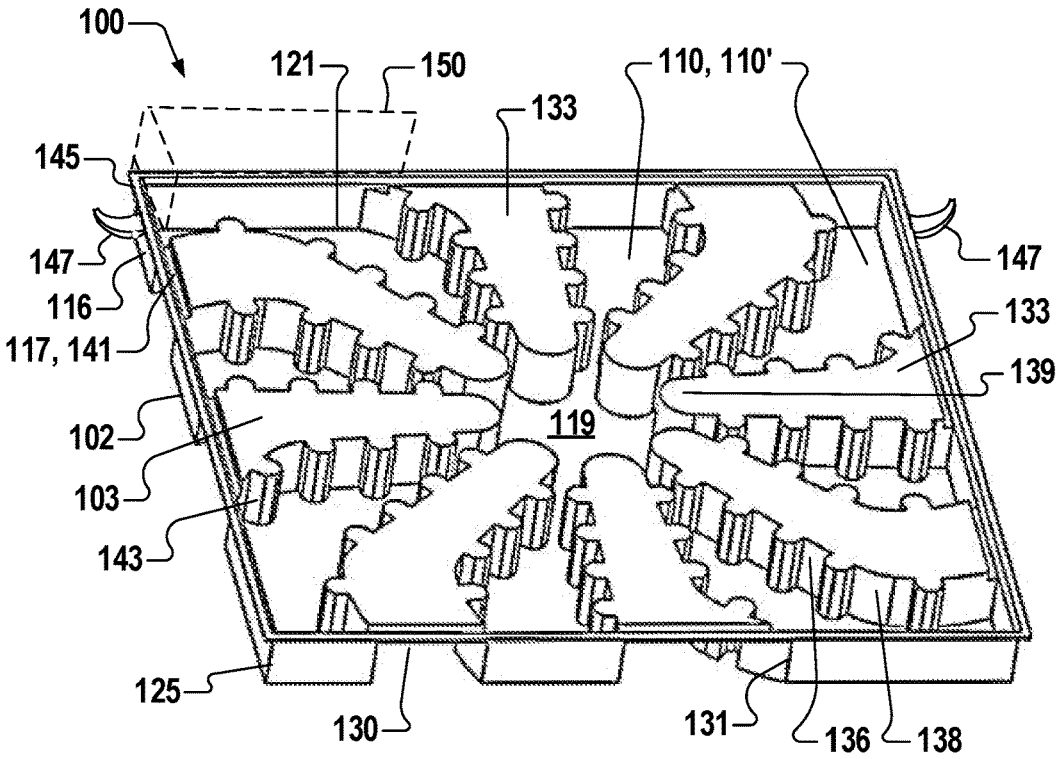
FIG. 25 is a bottom perspective view of the pad of FIG. 24.
Figure 26:
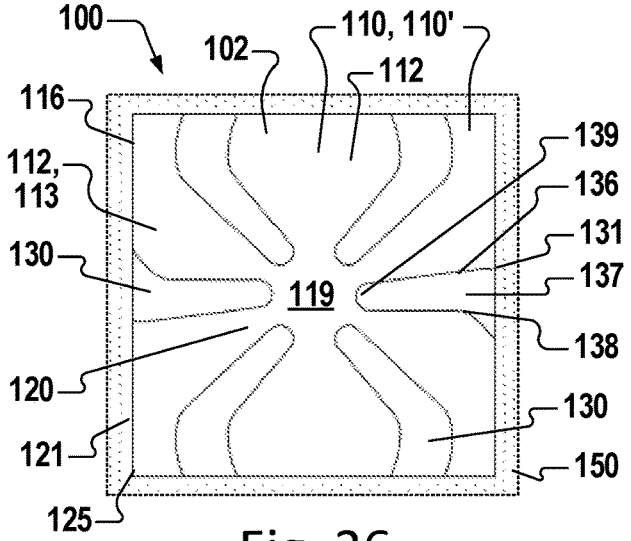
FIG. 26 is a top view of an equipment pad.
Figure 29:
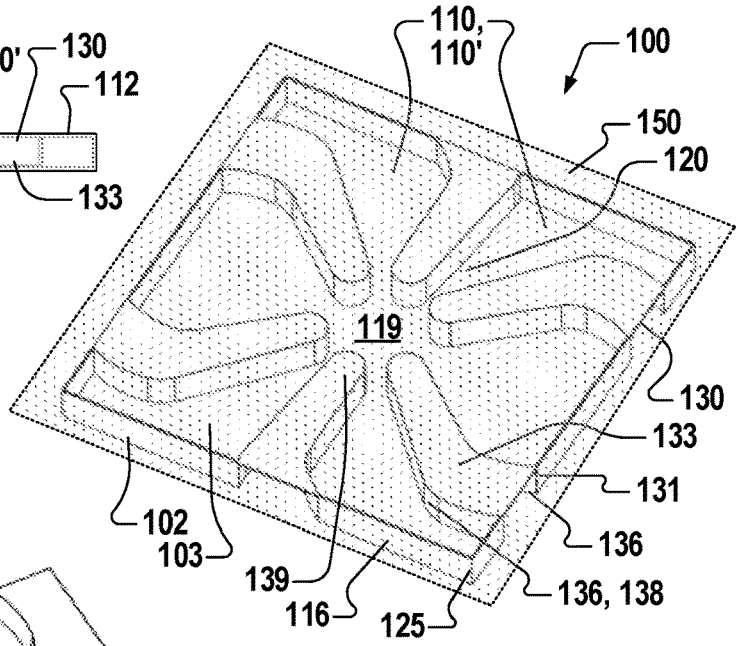
FIG. 29 is a bottom perspective view of the pad of FIG. 26.
Figure 30:
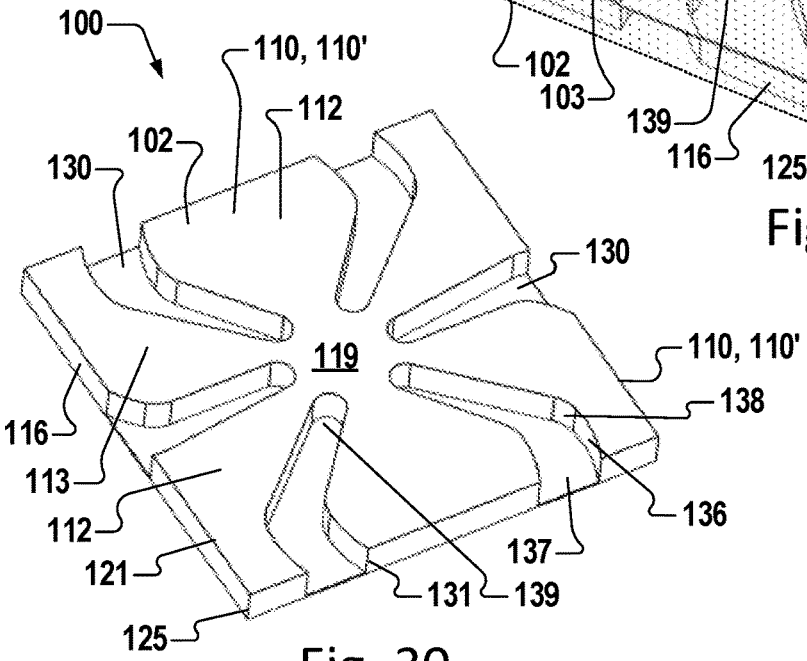
FIG. 30 is a top perspective view of the pad of FIG. 26.

In a preferred embodiment the shell-like structure of the equipment pad 100 forms a barrier to deter water from passing through to the underside of the pad 100, as the integrity of the installation relies on retention of soil 3 under the pad 100 in order to remain level. "Level" is a relative term, as most manufacturers actually prefer a slope of 2° or so to aid drainage of condensate, and equipment 10 does not require a perfectly level installation or perfectly level pad 100. The proportion and spacing of the channels 130 and risers 110 aid the installer in leveling the equipment pad 100 on soil 3. Contact of the pad 100 with the soil is uniform and substantial, yet the space under the risers 110 allows for excess or uneven soil 3 to shift or be positioned within the risers 110. A geocomposite or sheet-like material may be bonded to the bottom surface 103 of the pad 100 to provide flexible soil 3 support (FIGS. 25 and 29).

Figure 7:
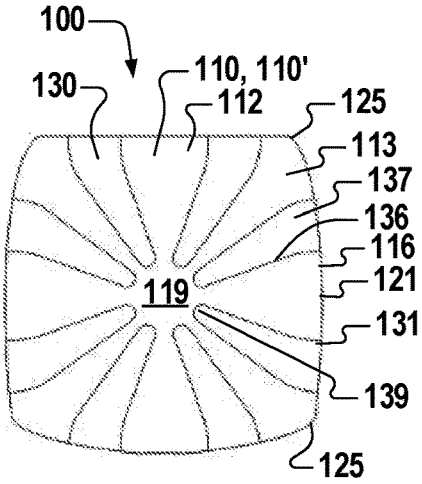
FIG. 7 is a top view of the structure of FIG. 5 as a wedge shaped pad.
Figure 8:
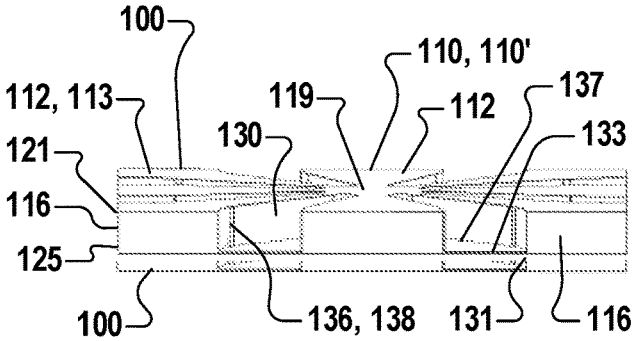
FIG. 8 is a side perspective view of two pads of FIG. 5 nestably stacked.
Figure 9:
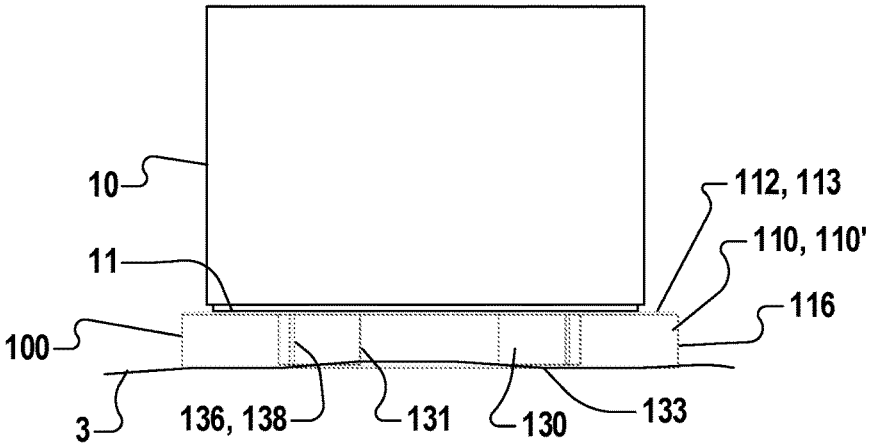
FIG. 9 is a side view of the pad of FIG. 5 installed and supporting an HVAC unit on the ground.
Figure 10:
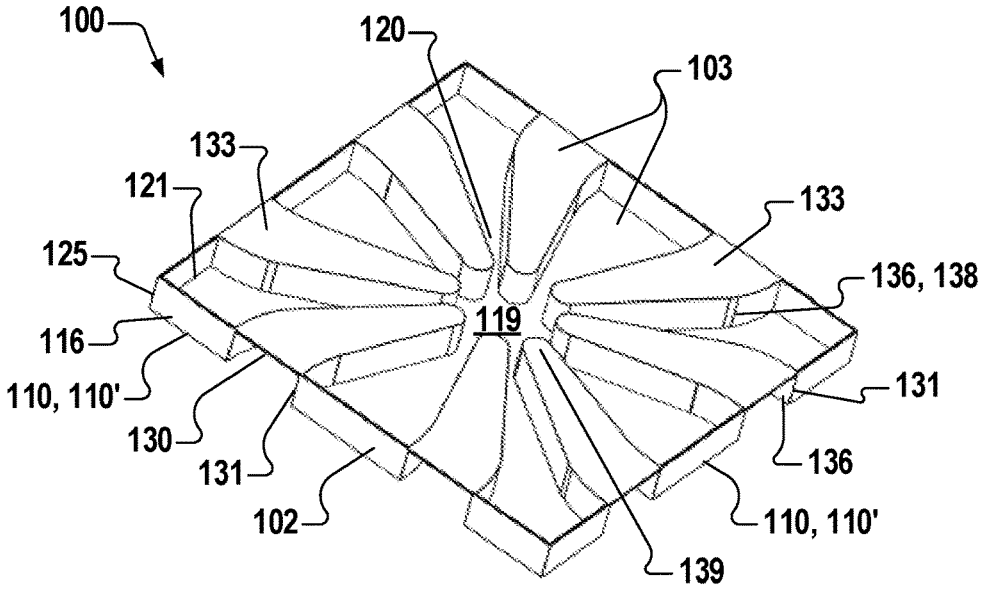
FIG. 10 is a bottom perspective view of the pad of FIG. 5.

The equipment pad 100 of FIGS. 5-13 is very similar to the pad 100 of FIG. 1, but its shorter risers 110 are wider and more rounded, providing slightly greater area of riser top 112 (about 59% of the pad 100), including equipment support surface 113, and slightly less area of channel bed 137 (about 41% of the pad 100). A trade-off such as this always exists in the present pad 100. The design of FIG. 5 also provides a greater area of perimeter side wall 116 (about 70% of the perimeter versus about 30% for the channel openings 131). The combined length of the side corners 125 is about 38% of the length of the perimeter. In a preferred side view such as that of FIG. 9, the equipment support surface 113 and the perimeter side walls 116 are of similar height so the equipment 10 rests on a pad 100 of uniform height and monolithic appearance, with surface profiles 104 or bends 138 causing the channel openings 131 to look narrower. FIG. 8 shows two pads 100 of like structure nestably stacked. FIG. 7 is the same basic structure applied to a "wedge" shaped pad 100.

Figure 11:
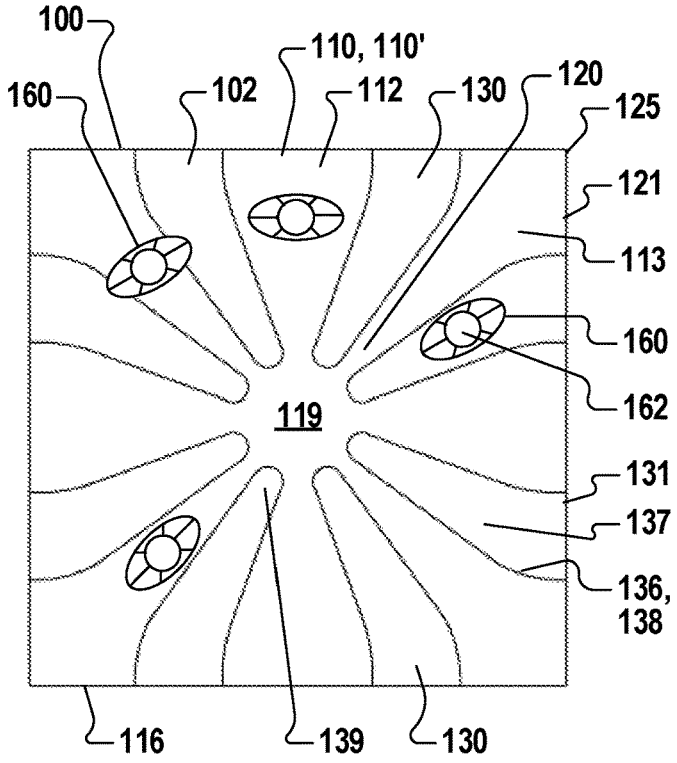
FIG. 11 is the top view of FIG. 6 illustrating addition of incremental risers.
Figure 12:
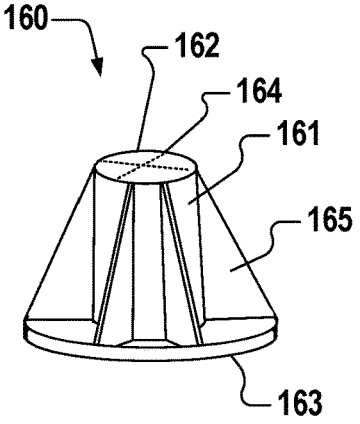
FIG. 12 is a perspective view of an incremental riser.
Figure 13:
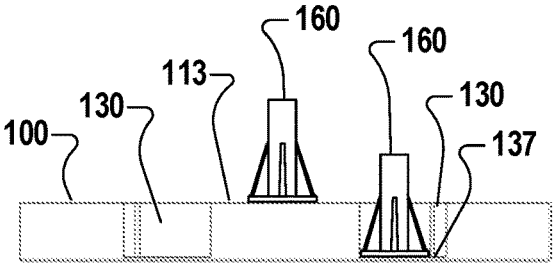
FIG. 13 illustrates heights of the incremental risers of FIG. 11.

In FIG. 11, incremental risers 160 are placed on the equipment pad 100 to provide additional clearance under the equipment 10, usually in snowy climates or on sloped terrain. Existing "heat pump risers" have square bases that may also be utilized on this pad 100. Here, an oval riser base 163 is illustrated as a means of spanning across channels 130 or fitting within channels 130, and a variety of positions are shown. The incremental riser base 163 rests on the pad 100 and holds incremental riser side wall(s) 161 and structural profiles 165 that raise an equipment support surface 162. The dashed lines of FIG. 12 illustrate optional ribbing 164 on or under the support surface 162. Usually at least four incremental risers 160 are placed under the equipment 10 for balanced support. The most popular additive riser height is 6", with other options including 3", 9", and 12", for example. As further illustrated in FIG. 13, use of 6" incremental risers 160 placed atop an equipment support surface 113 that is 3" above grade 3 results in an additional clearance of 6" between the equipment 10 and pad 100. Or, placement of the 6" incremental risers 160 between risers 110 on the channel bed 137 results in an additional clearance of 3" between the equipment 10 and pad 100. Thus one incremental riser 160 may serve the function of two existing heat pump risers of different heights.

Figure 14:
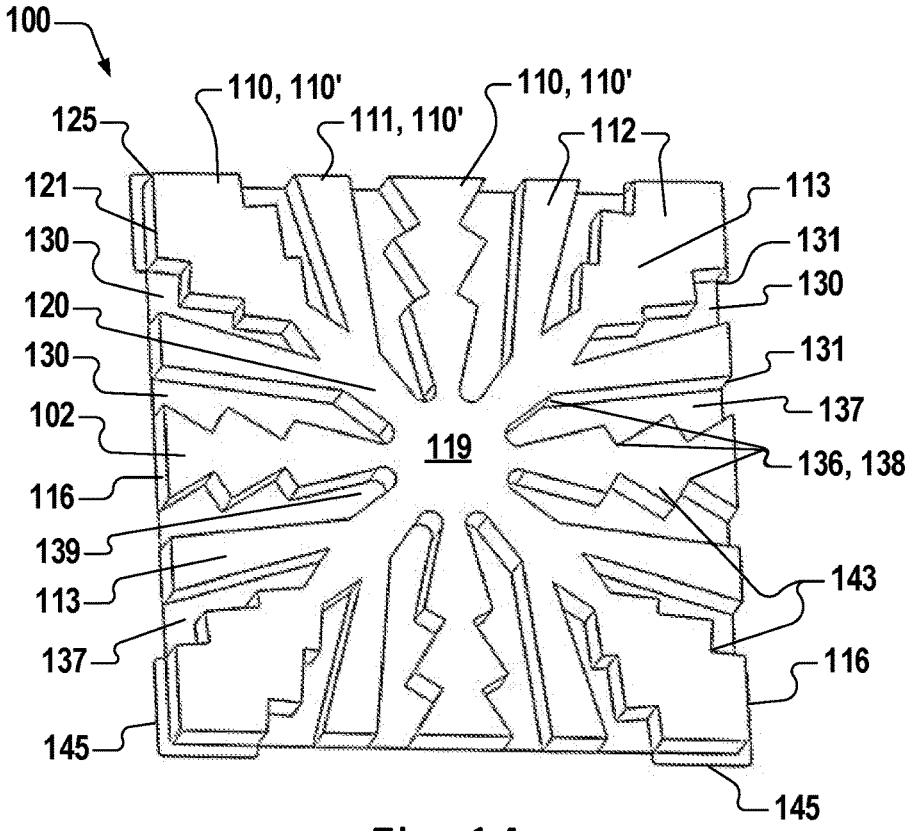
FIG. 14 is a top perspective view of an equipment pad.
Figure 15:
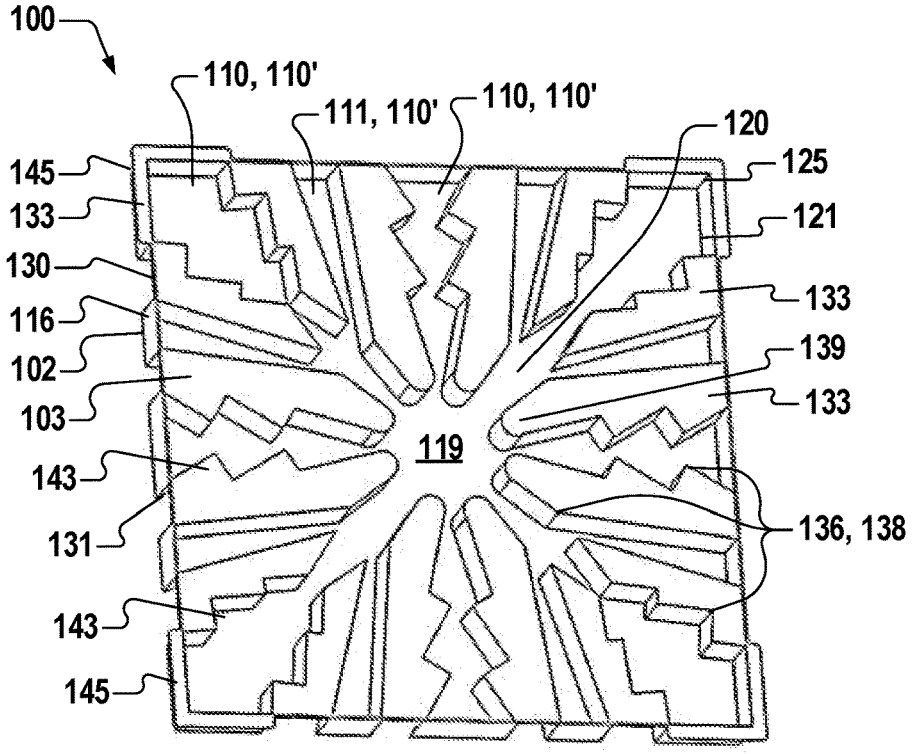
FIG. 15 is a bottom perspective view of the pad of FIG. 14.
Figure 16:
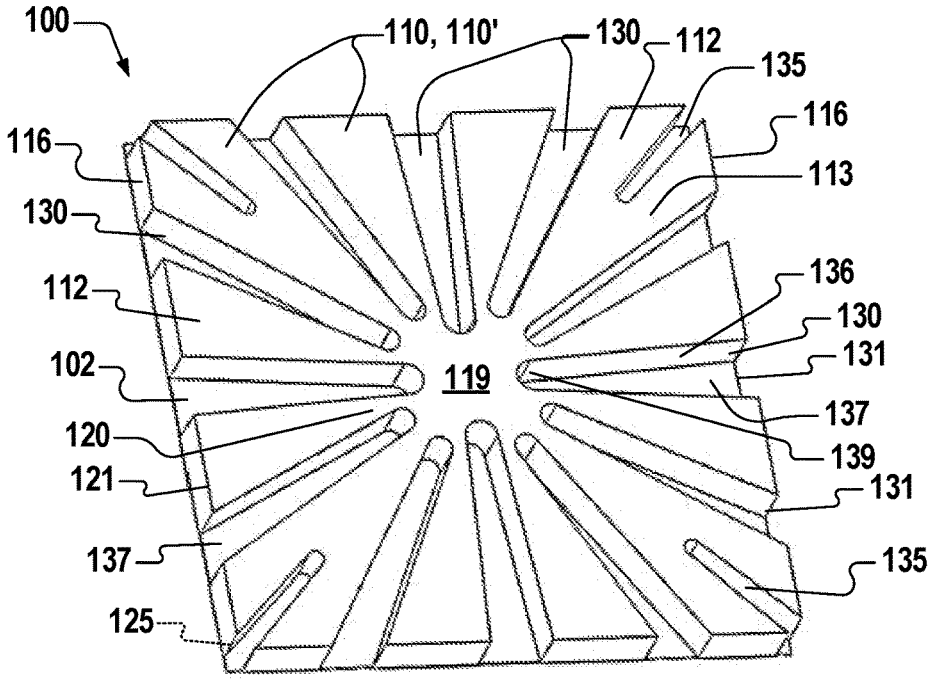
FIG. 16 is a top perspective view of an equipment pad.
Figure 17:
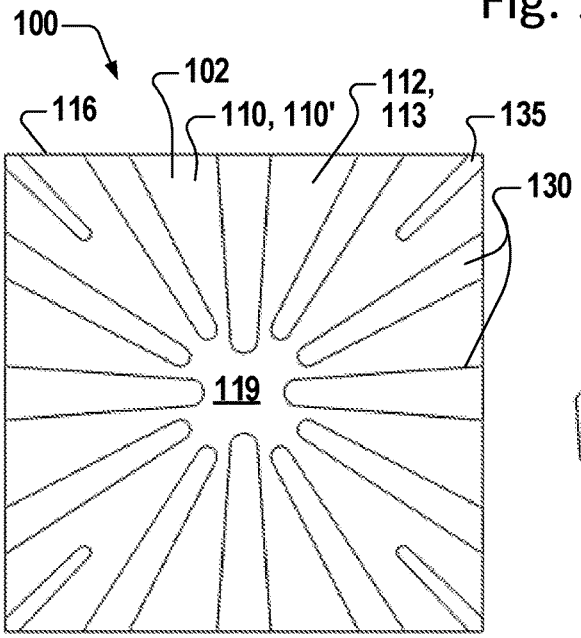
FIG. 17 is a top view of the pad of FIG. 16.
Figure 18:
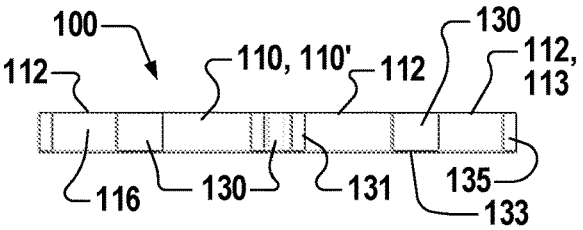
FIG. 18 is a side view of the pad of FIG. 16.
Figure 19:
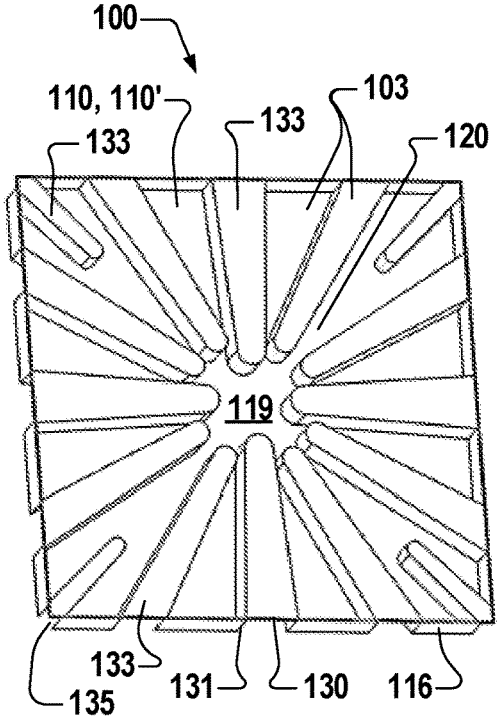
FIG. 19 is a bottom perspective view of the pad of FIG. 16.
Figure 20:
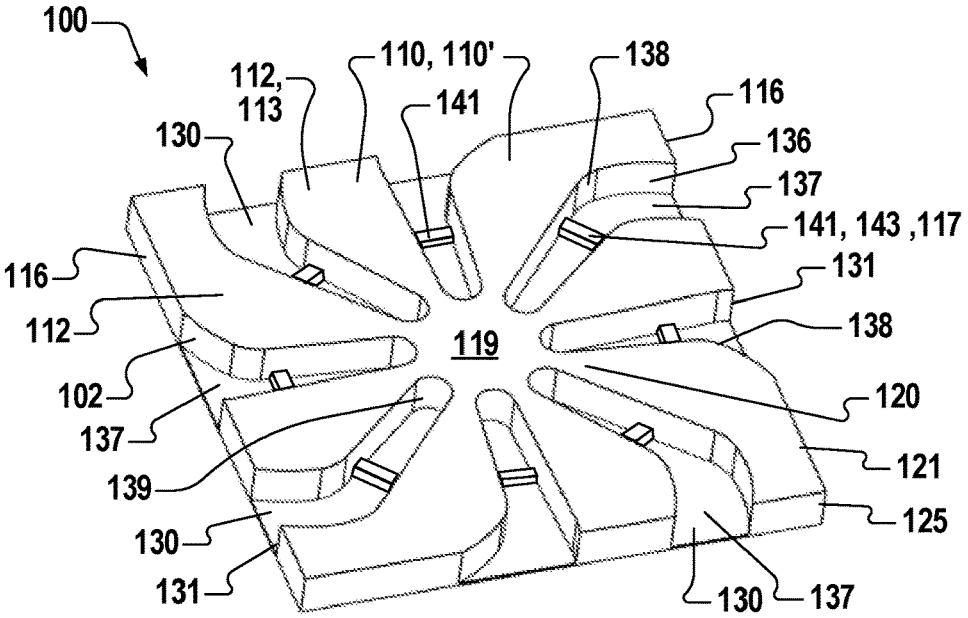
FIG. 20 is a top perspective view of an equipment pad.
Figure 21:
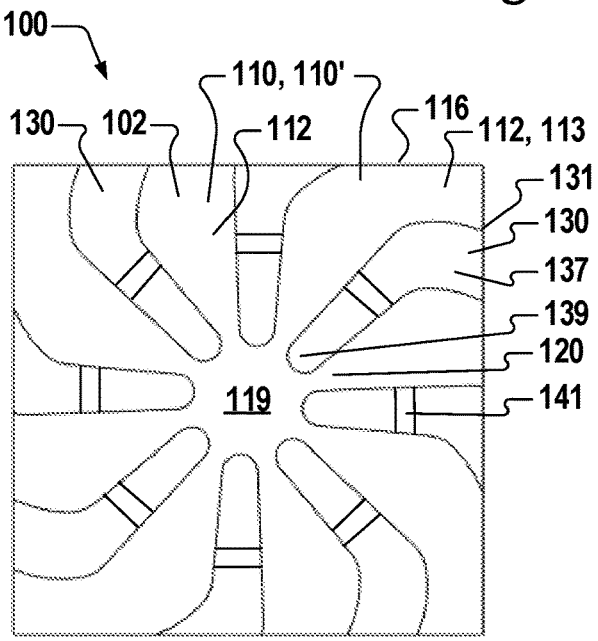
FIG. 21 is a top view of the pad of FIG. 20.

Turning now to FIGS. 14-15, a top perspective view shows an equipment pad 100 having central portion 119 from which eight risers 110 originate. Four diagonal risers 110 extend to the side corners 125, with branches that form secondary risers 111 that may increase the total equipment support surface 113 and reduce bowing. Risers 110 have nonlinear cut-ins or bends 138 that are structural profiles 143 strengthening the channel side walls 136, with the structural profiles 143 preferably angled to allow water and debris to wash out of the channels 130 without restricting flow. The bottom view in FIG. 15 shows the corner lip 145 at the perimeter provides extra ground support surface 133. By visual approximation, the channel openings 131 comprise about 36% of the perimeter of the pad 100, and the channel beds 137 comprise about 38% of the pad 100 versus the riser tops 112 at about 62%. The side corners 125 comprise about 34% of the length of the perimeter.

In FIGS. 16-19, an equipment pad 100 has twelve risers 110 and twelve channels 130 that originate from the central portion 119 of the pad 100 and flare laterally (with each channel side wall 136 as shown extending linearly after leaving the central portion 119). Secondary channels 135 at the side corners 125 provide additional ground support surface 133. Alternatively, the secondary channels 135 may be considered structural profiles 143 on the perimeter side walls 116. One of skill in the art will understand that in this design the secondary channels 135 intersect the side corners 125 of the pad. In other words, the pad is still understood to have side corners 125 even though the corners 125 are not monolithic, which means the pad 100 resembles a traditional poured concrete pad to a lesser extent. The horizontal extents of the channel openings 131 comprise about 28% of the perimeter of the pad 100, and the area of the channel beds 137 comprise about 38% of the area of the pad 100 versus the area of the riser tops 112 at about 62%. The side corners 125 comprise about 32% of the length of the perimeter.

Figure 22:
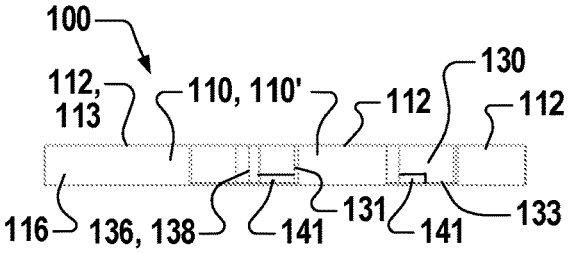
FIG. 22 is a side view of the pad of FIG. 20.
Figure 23:
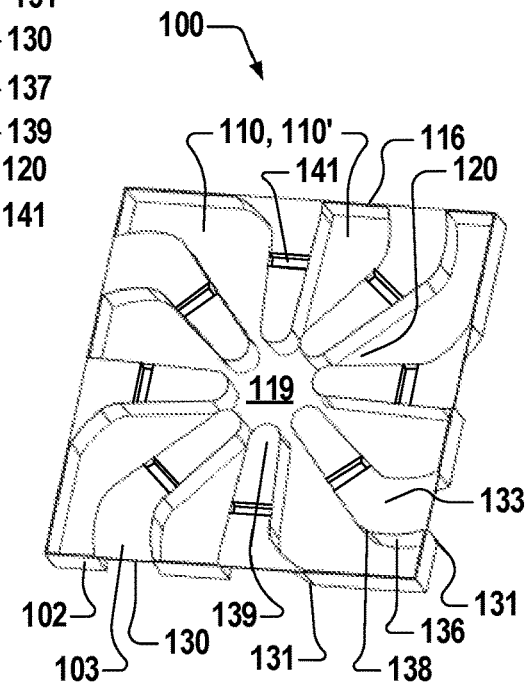
FIG. 23 is a bottom perspective view of the pad of FIG. 20.
Figure 24:
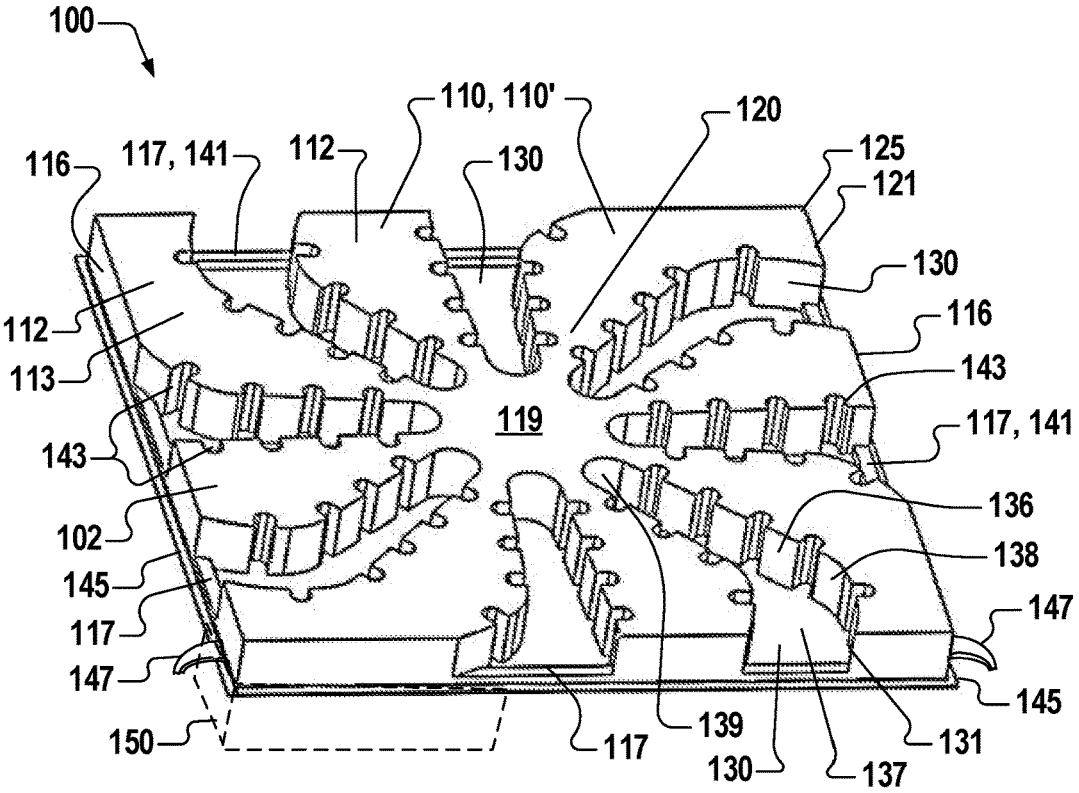
FIG. 24 is a top perspective view of an equipment pad.

In FIGS. 20-25, an equipment pad 100 has eight channels 130 that curve outward from the central portion 119 with bends 138 on the side walls 136. Eight risers 110 somewhat resemble a fan or palm fronds. Structural channel-spanning members 141 are structural profiles 143 located on channel beds 137 and adjoining channel side walls 136. These members 141 are not limited to a uniform height or symmetrical shape and may be taller at one channel side wall 136 than at the adjoining channel side wall 136, primarily to avoid great impedance of drainage. In FIGS. 24-25, notches, inverted ribs, or other structural and surface profiles 143, 104 on the channel side walls 136 may cooperate with incremental riser 160 structures (not shown here) to lock or hold the incremental riser 160 in place. As illustrated in FIG. 22, the channel bends 138 seen from the side of the pad 100 may provide an illusion that the channels 130 are narrower than they actually are, such that the pad 100 looks more monolithic. The channel openings 131 comprise about 42% of the perimeter of the pad 100, and the channel beds 137 comprise about 32-40% of the pad 100 versus the riser tops 112 at about 68-60%, with the notches decreasing riser top 112 area. The side corners 125 comprise about 43% of the length of the perimeter.

FIGS. 24-25 show a lip 145 about the entire perimeter of the equipment pad 100 and short dam walls 117 at the channel openings 131. These dam walls 117 may be about ¼" to 1" tall on a 2" to 3" tall pad in order to deflect drainage from entering the channels 130 from outside the perimeter of the pad 100 while still allowing the channels 130 to drain over the dam walls 117. Alternatively, the dam walls 117, which are structural channel-spanning members 141, may be inset within the channels 130 and not directly at the channel openings 131. Dam walls 117 reduce bowing of the pad 100, and may enhance a monolithic appearance. "Kick-outs," wing dikes, or other drainage barriers 147 are profiles on the perimeter side wall(s) 116 that are integrally formed with the pad 100 or added later near the side corners 125 located on at least the downward slope of an installed pad 100 to divert drainage away from the side corners 125, thus preserving the ground or soil 3 under the side corners 125. As with dam walls 117, drainage barriers 147 are not limited to the shape shown, but may be vertical, ramped, larger, or of different curvature, for example, provided the functionality of redirecting water away from the pad's perimeter is achieved. For additional protection of soil 3 at the side corners 125, an erosion control barrier 150 (represented by dashed lines) may wrap around the side corner 125 and attach to the lip 145, perimeter side walls 116, and/or dam walls 117. When soil 3 is protected under the side corners 125, that soil 3 maintains support for the equipment 10.

Figure 27:
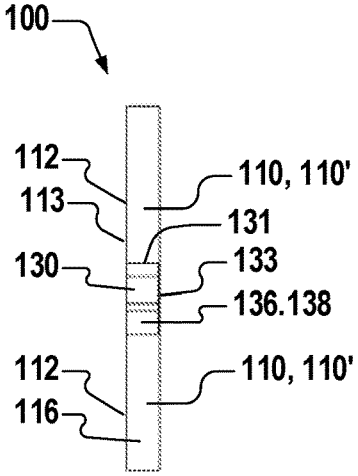
FIG. 27 is a side view of the pad of FIG. 26.
Figure 28:
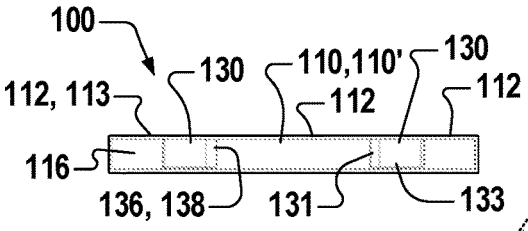
FIG. 28 is an adjoining side view of the pad of FIGS. 26 and 27.

The pad of FIGS. 26-30 is a mashup of shapes previously shown. Six channels 130 originate at channel heads 139 and extend outwardly from the central portion 119 of the pad 100, curving to varying degrees via bends 138 in the channel side walls 136 before reaching channel openings 131 at the perimeter side walls 116. As shown, four risers 110 fan out to the side corners 125, and two "fat" risers 110 reach out to two perimeter side walls 116. Thus, the side views of adjacent sides of the pad 100 are different. FIG. 27 illustrates one channel 130 in an otherwise monolithic perimeter side wall 116. FIG. 28 illustrates two channels 130 in the perimeter side wall(s) 116. Even with significant curves or bends 138 in the channels 130, the pathway for flow of drainage is maintained. Drainage from the pad 100 or the ground 3 may be deflected from the soil 3 under the pad 100 by erosion control barrier 150 illustrated in FIGS. 26 and 29 as a geotextile or sheet attached at the bottom of the side walls 116 and covering the underside of the pad 100. Such a sheet of erosion control barrier 150 will add ground support at the cost of nestability unless cuts are made in the sheet 150 to allow at least some nesting. The horizontal extents of the channel openings 131 comprise about 22% of the perimeter of the pad 100, and the area of the channel beds 137 comprise about 33% of the pad 100 versus the area of the riser tops 112 at about 67%. The side corners comprise about 54% of the length of the perimeter.

Figure 31:
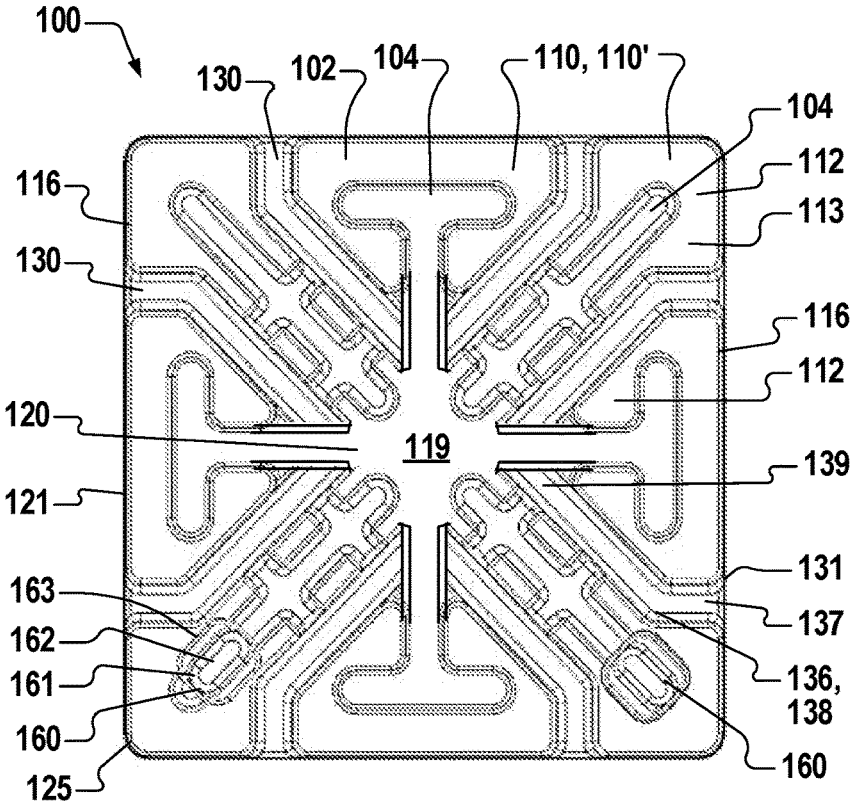
FIG. 31 is a top view of an equipment pad.
Figure 32:
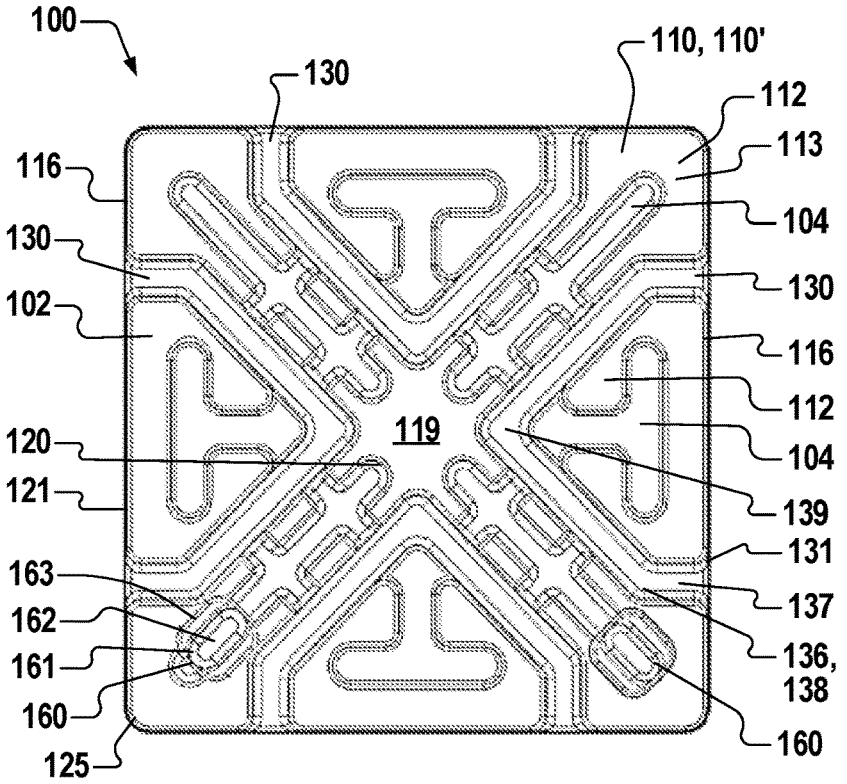
FIG. 32 is a top view of an equipment pad.

In FIG. 31, an equipment pad 100 comprises eight risers 110, with four diagonal risers 110 flaring out at the side corners 125 and four fat risers 110 located between the diagonal risers 110. Eight uniform channels 130 reside between the risers 110. Numerous surface profiles 104 form wide inverted ribbing 114 under the equipment support surface 113 and allow placement and adjustment of incremental risers 160 (two are shown). The channels 130 have similar widths as the surface profiles 104 in order to allow more placement options for the incremental risers 160 across the pad 100. FIG. 32 illustrates the same equipment pad 100 as in FIG. 31, but with V-shaped channels 130 cutting the fat risers 110 off from the central portion 119 of the pad. In FIGS. 31-32, the horizontal extents of the channel openings 131 comprise about 15% of the perimeter of the pad 100, and the area of the channel beds 137 comprise about 24% of the area of the pad 100 versus the area of the riser tops 112 at about 76%. The side corners 125 comprise about 41% of the length of the perimeter.

Figure 35:
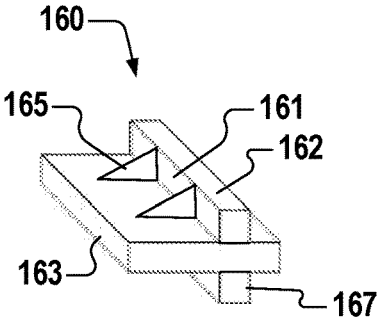
FIG. 35 is a perspective view of an incremental riser.
Figure 36:
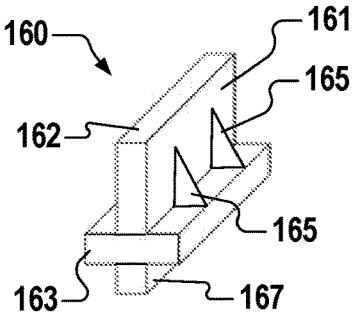
FIG. 36 is another perspective view of the incremental riser of FIG. 35.

FIGS. 35-36 illustrate the basic structure and functionality of incremental risers 160 similar to those of FIG. 31-32. Each incremental riser 160 has a base 163 that rests upon the pad 100, with incremental riser side walls 161, an equipment support surface 162, and typically ribs or structural profiles 165 to strengthen the incremental riser side walls 161. Additionally, a base insert 167 under the base 163 is shaped to cooperate with the pad design to stabilize and optionally lock in place the incremental risers 160 on the equipment pad 100. For example, in FIGS. 31-32 the base insert (not shown) may be placed securely in any of the many diagonal, horizontal, or vertical channels 130 or surface profiles 104, thereby providing an installer with options in the field. In the design of FIGS. 35-36, at least two different heights may be realized depending upon orientation. FIG. 35 provides a 6" wide base 163 and a 3" rise, for example, as determined by the distance from the bottom of the base 163 to the equipment support surface 162. Flipping the same unit 90° to the right results in FIG. 36 and provides a 4½" base 163 and a 6" rise, as determined by the distance from the bottom of the portion that is now the base 163 to the portion that is now the equipment support surface 162. Incremental risers 160 are not limited to the rounded, squared, or straight structures of the specific depictions in the figures described above, but may be may be asymmetrical, crescent-shaped, or other shapes.

Figure 33:
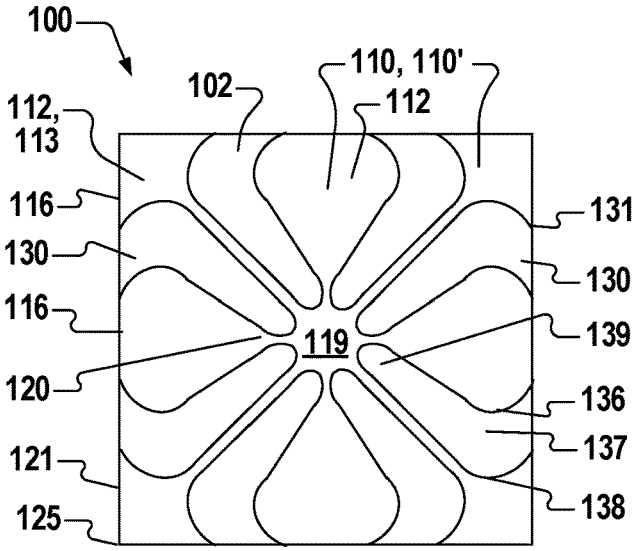
FIG. 33 is a top view of an equipment pad.
Figure 34:
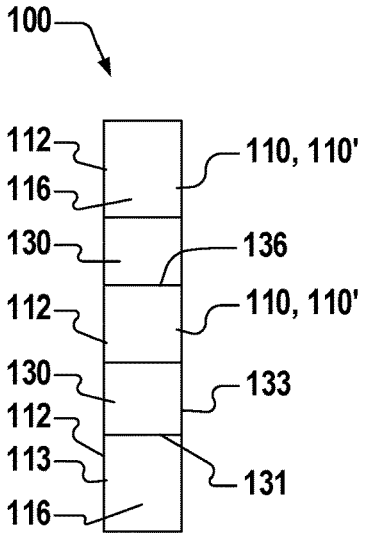
FIG. 34 illustrates a side of the pad of FIG. 33.

The equipment pad 100 of FIGS. 33-34 also is a mashup of related riser 110 and channel 130 shapes. The most obvious difference is the combination of very narrow and very "fat" riser portions 110'. The horizontal extents of the channel openings 131 comprise about 30% of the perimeter of the pad 100, and the area of the channel beds 137 comprise about 47% of the area of the pad 100 versus the area of the riser tops 112 at about 53%. The side corners comprise about 43% of the length of the perimeter.

Figure 37:
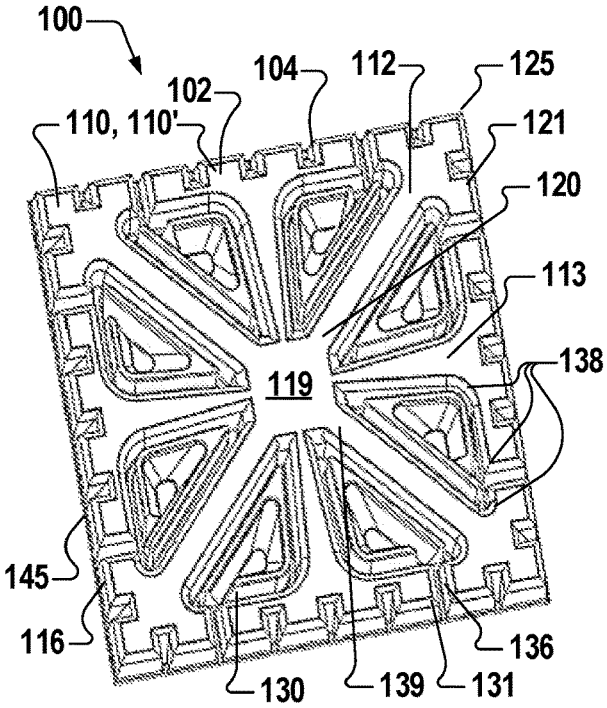
FIG. 37 is a top perspective view of an equipment pad.
Figure 38:
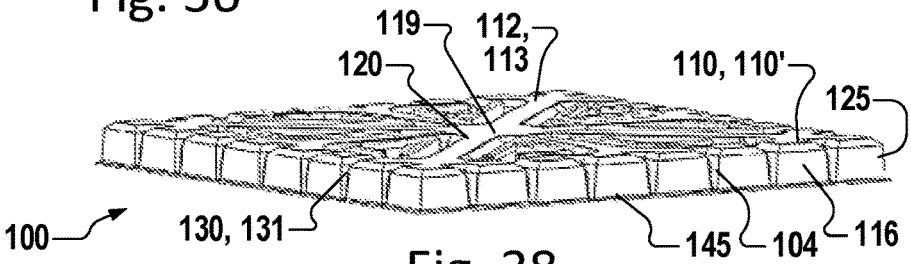
FIG. 38 is a side perspective view of the pad of FIG. 37.

In FIGS. 37-38, an equipment pad 100 comprises eight risers 110 that are narrow for much of their length until they broaden or flare laterally to the perimeter edge 121. Eight pocket-like channels 130 with bends 138 have narrow channel openings 131 at the perimeter side walls 116. Viewed from the side, the channel openings 131 appear the same as structural profiles 104 on the perimeter side walls 116, giving a uniform appearance. Within the channels 130 are secondary risers 111 that form secondary channels 135. Even with such pockets forming a challenge to drainage, the water pathways are directed to the channel openings 131. A lip 145 surrounds the entire perimeter. The horizontal extents of the channel openings 131 comprise about 3% of the perimeter of the pad 100, and the area of the channel beds 137 comprise about 23% of the area of the pad 100 versus the area of the riser tops 112 at about 77%. The side corners comprise about 46% of the length of the perimeter.

Figure 39:
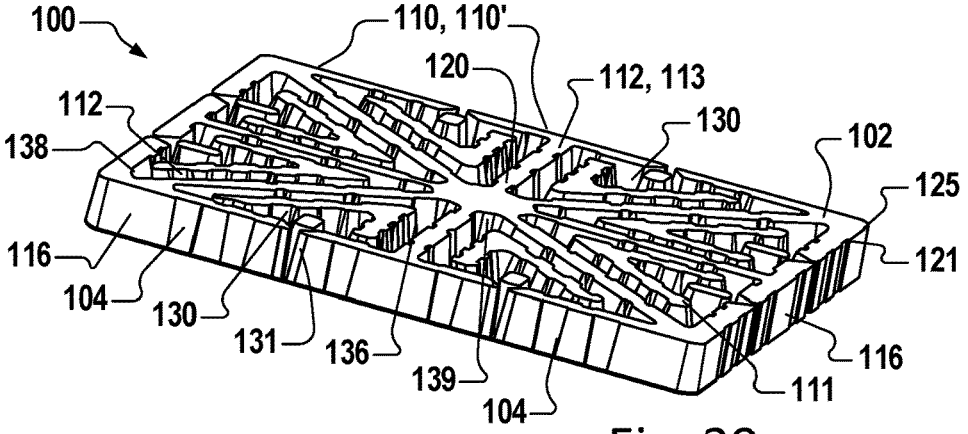
FIG. 39 is a perspective view of an equipment pad.
Figure 40:
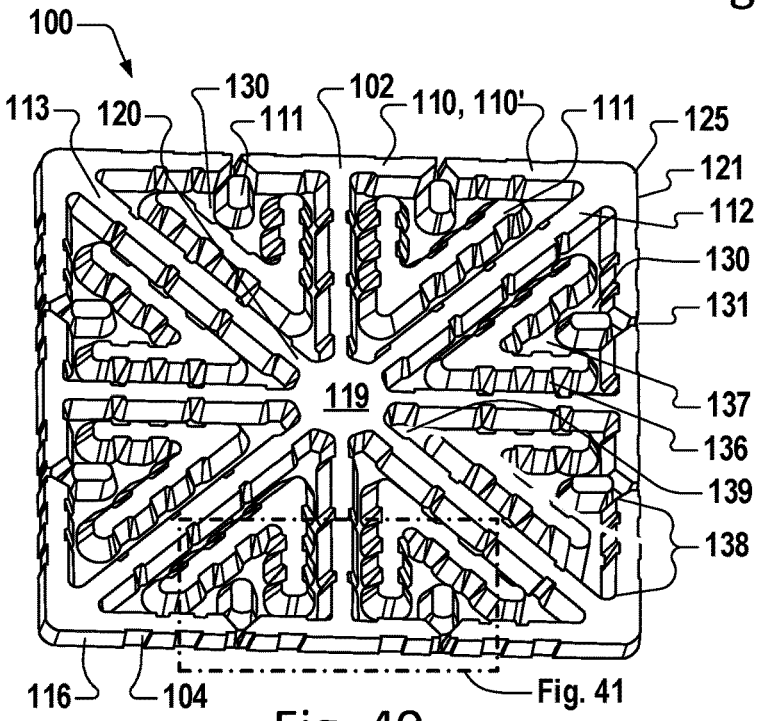
FIG. 40 is a top perspective view of the pad of FIG. 39.
Figure 41:
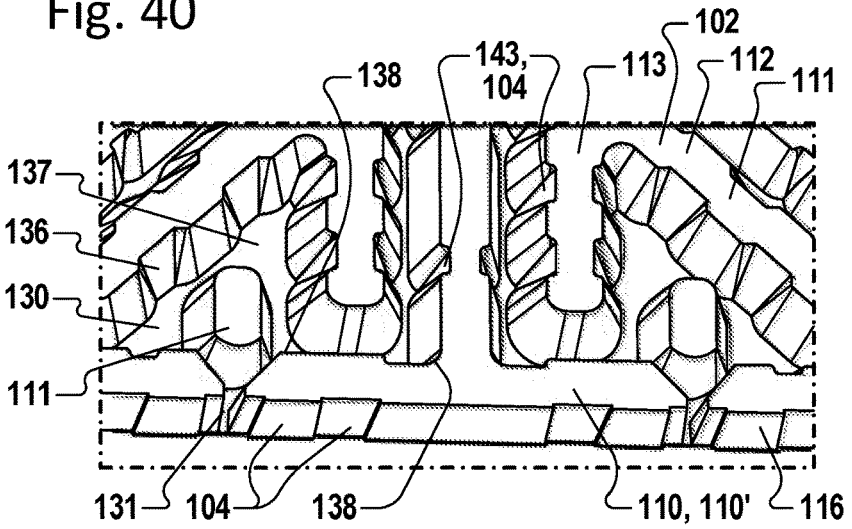
FIG. 41 is a close-up view of a section of the pad of FIG. 40.
Figure 42:
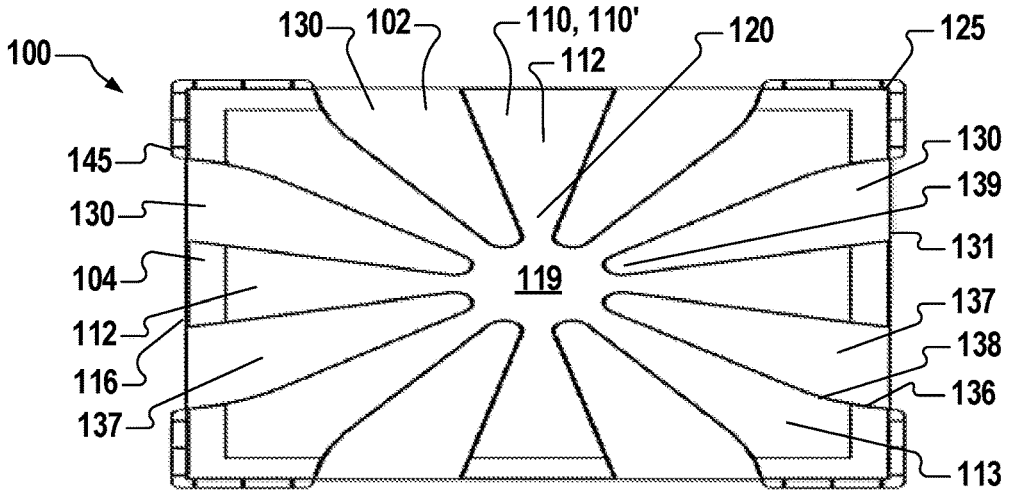
FIG. 42 is a top view of a non-square equipment pad.
Figure 43:
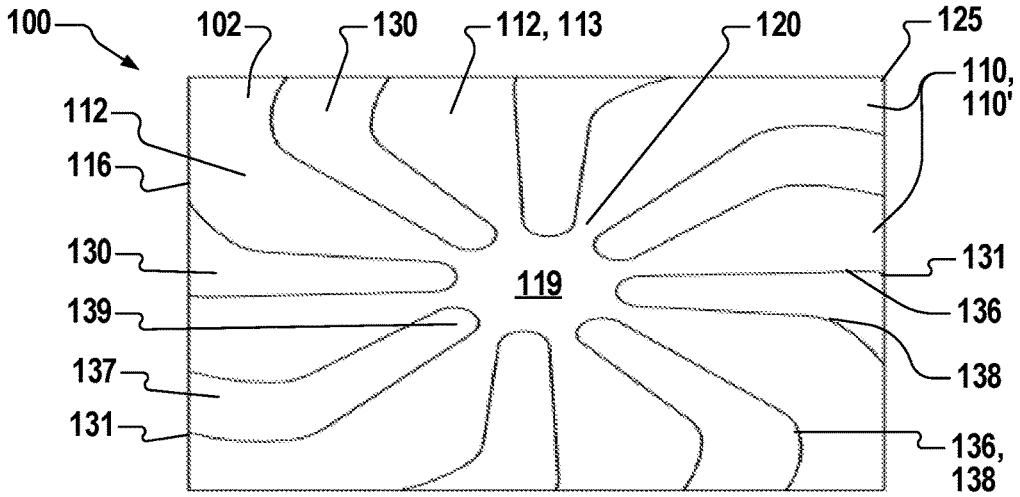
FIG. 43 is a top view of a non-square equipment pad.
Figure 44:
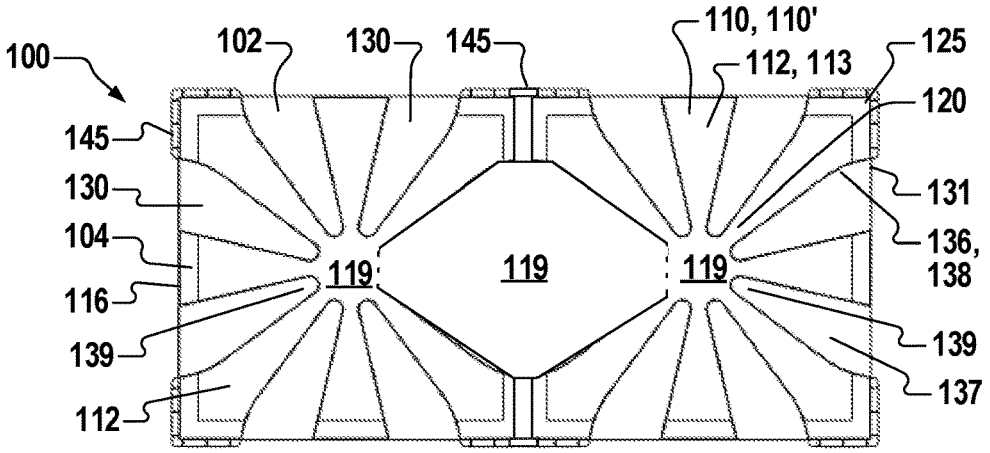
FIG. 44 is a top view of a non-square equipment pad.

FIGS. 39-41 illustrate a simpler version of the equipment pad 100 of FIGS. 37-38. The structural surface profiles 104 on the perimeter side walls 116 are less pronounced. Secondary risers 111 and secondary channels 135 are less complex, with a small bulwark or secondary riser 111 added near the channel openings 131. Structural profiles 143 on the channel side walls 136 increase the strength of the pad 100. Notably, the risers 110 widen as they extend outwardly from the central portion 119 of the pad 100 and bend to the perimeter side walls 116, flaring laterally. "Flare laterally" can mean "flare from the center to the sides" or "after extending to the side wall, flare laterally (perpendicular to or along the side wall)." The horizontal extents of the channel openings 131 comprise about 2% of the perimeter of the pad 100, and the area of the channel beds 137 comprise about 34% of the area of the pad 100 versus the area of the riser tops 112 at about 66%. The side corners comprise about 74% of the length of the perimeter. The pads 100 of FIGS. 37-41 typically require more material, and thus more weight and expense (and potentially difficulty of manufacturing), than the other pads 100 described herein. Weight and expense affect structural considerations and the targeted balance of ground support and equipment support in a preferred design that values lighter weight and lower expense.

In FIGS. 7 and 42-44, examples of non-square pads 100 are shown using shapes similar to those discussed. Sizes of current popular pad footprints include 36"×36", 32"×32", 36"×48", 24"×36", and 18"×36", for example, with pad heights ranging from nominal 2" to 4". Equipment pads 100 are not limited to rectangular shapes, but may have curved perimeter side edges 116.

Where this specification describes a parameter as "about" some specific number or range of numbers, "about" means the specific number or range of numbers +/−10%.

It will be understood that many modifications could be made to the embodiments disclosed herein without departing from the spirit of the invention. Having thus described exemplary embodiments of the present invention, it should be noted that the disclosures contained in the drawings are exemplary only, and that various other alternatives, adaptations, and modifications may be made within the scope of the present invention. Accordingly, the present invention is not limited to the specific embodiments illustrated herein, but is limited only by the following claims.

We claim:

1. An equipment pad comprising:

(a) at least four risers having riser tops that extend outwardly from a central portion of the equipment pad, broaden along at least portions of the at least four risers, and turn to extend downwardly to form a perimeter side wall of the equipment pad, wherein the at least four risers comprise an equipment support surface; and (b) at least four channels having channel beds and channel side walls that extend outwardly from the central portion of the equipment pad, wherein the at least four channels comprise a ground support surface;

wherein the channel side walls adjoin or merge into the perimeter side walls of the equipment pad to form channel openings that allow drainage to exit the at least four channels;

wherein the horizontal area of the channel beds comprises from about 20% to 50% of the total combined horizontal area of the channel beds and riser tops of the equipment pad; and wherein the ground support surface of the at least four channels supports the equipment pad on soil and the equipment support surface of the at least four risers supports the equipment placed on the equipment pad.

2. The equipment pad of claim 1, wherein each channel is located between and shares side walls with two of the at least four risers.

3. The equipment pad of claim 1, wherein each channel is wider at the channel opening than at the central portion of the equipment pad.

4. The equipment pad of claim 1, further comprising a secondary riser that branches off of one of the at least four risers.

5. The equipment pad of claim 1, comprising at least eight risers and at least eight channels.

6. The equipment pad of claim 1, further comprising bends in the at least four channels or the at least four risers.

7. The equipment pad of claim 1, further comprising a structural channel-spanning member.

8. An equipment support pad comprising:

(a) a terrace that extends outward from a central portion of the support pad to form at least four legs that are broader at the perimeter of the pad than at the area where they extend from the central portion, wherein the at least four legs support the equipment loaded thereon;

(b) a ground support surface that bears the equipment-loaded support pad on soil;

(c) channels disposed between the terrace and ground support surface and comprising channel side walls, channel beds, and channel openings defined along the perimeter of the support pad; and (d) perimeter side walls connecting the terrace and channels about the perimeter of the equipment pad and adjoining the channel openings;

wherein the channel openings together span from about 15% to 50% of the perimeter of the equipment pad.

9. The support pad of claim 8, wherein the terrace has a greater area than the area of the channel beds.

10. The support pad of claim 8, wherein perimeter side walls extend from the channels to form side corners having continuous perimeter side walls.

11. The support pad of claim 8, wherein perimeter side walls extend from the channels to form a side corner having a secondary channel.

12. The support pad of claim 8, wherein a perimeter side wall between two side corners comprises at least two channel openings.

13. The support pad of claim 8, further comprising structural or other profiles on the terrace, ground support surface, channels, or perimeter side walls.

14. The support pad of claim 8, further shaped to be nestable with a similarly shaped support pad.

15. The support pad of claim 8, comprising at least five channels and at least five legs of the terrace.

16. The support pad of claim 8, comprising at least eight channels and at least eight legs of the terrace.

17. The support pad of claim 8, the ground support surface comprising varying heights or curvatures along the channel beds.

18. The support pad of claim 8, further comprising a bottom surface and a geocomposite or sheet-like material attached to the perimeter side walls or the bottom surface.

19. The support pad of claim 8, further comprising incremental risers shaped to be placed on the terrace or in the channels.

20. The support pad of claim 8, wherein at least one channel side wall bends from a center portion of the equipment pad toward a perimeter side wall.

21. The support pad of claim 20, wherein the at least four legs each have at least one bent side wall or terrace.

22. An equipment pad comprising:

(a) a plurality of equipment-supporting plateaus extending from a central region of the equipment pad toward a perimeter of the equipment pad and flaring laterally;

(b) a plurality of channels comprising channel openings and formed by channel side walls and ground-contacting channel beds;

(c) side walls comprising the channel side walls and perimeter side walls that join the plateaus and channels; and (d) a plurality of corners, wherein each corner is defined by a corresponding plateau;

wherein the channel openings span sections of the pad where the channel side walls merge into the perimeter side walls.

23. The equipment pad of claim 22, wherein the plateaus extend along a nonlinear path from the central region of the pad to the perimeter of the pad.

24. The equipment pad of claim 23, wherein the nonlinear path is a curved or otherwise bent path.

25. The equipment pad of claim 22, wherein the equipment pad has a polygonal shape.

26. The equipment pad of claim 22, wherein the perimeter side walls of the plurality of corners have a combined length of at least 20% of the perimeter of the pad.

27. The equipment pad of claim 22, wherein the channel openings span from 15% to 50% of the perimeter of the pad.

28. The equipment pad of claim 22, wherein the channel side walls form a pocket between adjoining plateaus, and wherein the channel openings span from 2% to 30% of the perimeter of the pad.

* * * * *